US005868817A

United States Patent [19]

Yano et al.

[11] Patent Number: 5,868,817

[45] Date of Patent: Feb. 9, 1999

[54] PROCESS FOR PRODUCING STEEL BY CONVERTER

[75] Inventors: Masataka Yano; Yuji Ogawa, both of Futtsu; Masayuki Arai, Muroran; Fumio Koizumi, Muroran; Noriyuki Masumitsu, Muroran; Hideaki Sasaki, Muroran; Hiroshi Hirata, Muroran; Yoshiaki Kusano, Muroran; Hirobumi Maede, deceased, late of Muroran, by Yoko Meade, legal representative; by Noriko Kawai, legal representative; by Keiko Ikemizu, both of Sapporo, all of Japan, legal representative

[73] Assignee: Nippon Steel Corporation, Tokyo, Japan

[21] Appl. No.: 571,859

[22] PCT Filed: Jun. 30, 1994

[86] PCT No.: PCT/JP94/01070

§ 371 Date: Jul. 15, 1996

§ 102(e) Date: Jul. 15, 1996

[87] PCT Pub. No.: WO95/01458

PCT Pub. Date: Jan. 12, 1995

[51] Int. Cl.[6] ..... C21C 1/02

[52] U.S. Cl. ..... 75/528; 75/507; 75/433; 75/414; 75/392; 148/501; 148/503; 148/500

[58] Field of Search ..... 75/528, 507, 433, 75/414, 392; 148/501, 503, 500

[56] References Cited

U.S. PATENT DOCUMENTS

| | | | |
|---|---|---|---|
| 3,938,790 | 2/1976 | Knuppel et al. | 266/35 |
| 4,010,027 | 3/1977 | White | 75/52 |
| 4,174,212 | 11/1979 | Bauer et al. | 75/49 |
| 4,358,313 | 11/1982 | Yoshii et al. | 75/60 |
| 4,434,005 | 2/1984 | Metz et al. | 75/60 |

FOREIGN PATENT DOCUMENTS

| | | |
|---|---|---|
| 58-16007 | 1/1983 | Japan . |
| 62-109908 | 5/1987 | Japan . |
| 63-195209 | 8/1988 | Japan . |
| 2072221 | 9/1981 | United Kingdom . |
| 2122649 | 1/1984 | United Kingdom . |

OTHER PUBLICATIONS

10th Anniversary of 2D Committee by Japan BOT Group, LD Committee, 235, (1969).

*Primary Examiner*—Patrick Ryan
*Assistant Examiner*—M. Alexandra Elve
*Attorney, Agent, or Firm*—Kenyon & Kenyon

[57] ABSTRACT

The present invention provides a process for efficiently dephosphorizing, dephosphorizing and decarbonizing, or desulfurizing, dephosphorizing and decarbonizing a hot metal in a converter. The amount of flux to be charged and the amount of bottom-blown gas are adjusted so that the bottom-blowing agitation power and the $CaO/SiO_2$ ratio subsequent to the treatment become at least 0.1 kW/ton and from 0.7 to 2.5, respectively and the hot metal temperature at the treatment end point becomes from 1,200° to 1,450° C. Furthermore, the operation of the process is controlled so that the sum of a T.Fe concentration and a MnO concentration in the slag subsequent to the treatment becomes from 10 to 35% by weight by adjusting the top-blown oxygen feed rate, the flow rate of bottom-blown gas or the top-blowing lance height.

4 Claims, 11 Drawing Sheets

PROCESS FOR PRODUCING STEEL BY CONVERTER

FIELD OF INVENTION

The present invention relates to a refining process, using a converter having a bottom-blowing function, in steel production. The present invention relates, in more detail, to a converter refining process wherein molten iron is refined by desiliconization and dephosphorization in the same converter, intermediate slag discharge is conducted, and the molten iron is successively refined by decarbonization, and to the operation conditions of the dephosphorization refining.

PRIOR ART

Demand for quality of steel materials has become more strict as the utilization technologies become advanced and diversified, and the need for the production of a high purity steel has further increased. In order to meet such a requirement for the production of such a high purity steel, molten iron pretreatment installations or secondary refining installations have been enlarged and arranged in a steel production process. Since dephosphorization is particularly efficient in the molten iron stage where the temperature level is low, precedent dephosphorization is generally carried out in the molten iron pretreatment step. In precedent dephosphorization, there are refining vessel systems such as a torpedo car system, a ladle system and a two converter system where decarbonization is conducted in a separate furnace. Any of the systems can be carried out by charging flux such as CaO and iron oxide either through top addition or injection, and agitating through nitrogen bubbling or nitrogen bubbling and oxygen top blowing in combination. For example, Japanese Patent Publication Kokai No. 58-16007 discloses a *Process for Dephosphorizing and Desulfurizing Molten Iron* wherein a CaO flux is blown into a molten iron, together with a carrier gas, while oxygen is being top blown, the molten iron is subsequently dephosphorized so that the slag basicity and the iron oxide content subsequent to the treatment become at least 2.0 and up to 15%, respectively, top blowing oxygen is then stopped, and the molten iron is desulfurized by blowing a desulfurizing agent without forcibly removing the slag. Moreover, Japanese Patent Publication Kokai No. 62-109908 discloses a *Process for Desiliconizing, Dephosphorizing and Desulfurizing Moten Iron* wherein a dephosphorizing flux containing CaO as its main component is added to a molten iron surface from the initial stage of pretreating the molten iron, oxygen or an oxygen source in a solid state is added to the molten iron surface while iron oxide flux powder is being blown into the molten iron with a carrier gas, and the flux is changed to an alkali type flux after the desiliconization stage to conduct dephosphorization and desulfurization simultaneously. In addition to the Japanese Patent Publications mentioned above, Japanese Patent Publication Kokai No. 63-195209 discloses a *Process for Producing Steel* wherein two converters, a top-blowing converter and a bottom-blowing converter, are used, one is employed as a dephosphorizing furnace and the other is employed as a decarbonizing furnace, the converter slag produced in the decarbonizing furnace is recycled to the dephosphorizing furnace, and the dephosphorized molten iron obtained by dephosphorization is charged into the decarbonizing furnace.

As described above, in order to make the decarbonization step in a converter efficient and improve the productivity therein by carrying out the desiliconization step and the dephosphorization step as a primary refining process in the molten iron stage, steel companies have directed, their attention to separate refining and have conducted studies and realized installations of this type.

In view of only the capacity of the dephosphorization step according the process as mentioned above, a relatively low phosphorus content level can be achieved. However, the step has the following drawbacks: the treating time is long and the heat loss at the time of treating is large; it takes much time to supply the molten iron to a converter; and, even when two converters are utilized, a decrease in the molten iron temperature is unavoidable due to the discharge of the molten iron subsequent to the treatment from a first converter and the recharge thereof into the other converter. Accordingly, the process is by no means a satisfactory one in view of a heat margin. Moreover, dephosphorization of the total amount of the molten iron in recent years has further lowered the heat margin in the converter process. As a result, freedom to select the raw materials to be used is lost, and there will arise a serious problem, from the standpoint of positively recycling scrap in converters, in the future.

In contrast to the process as mentioned above, there is a refining process termed a double slag process wherein predephosphorization and decarbonization refining are practiced in one converter, as disclosed in the Collection of Papers in Commemoration of 10th Anniversary of LD Committee by Japan BOT Group, LD Committee, 235, (1969). The process is directed to conduct dephosphorization refining by soft blowing refining in the first blowing within a converter, and comprises discharging dephosphorizing slag in such a manner that the molten iron does not flow out from the furnace mouth subsequently to dephosphorization, and then conducting decarbonization refining continuously. However, there can be found no techniques in the process which improve the refining process and the slag dischargeability.

Although the double slag process has a high heat margin, the cost of the process is high and refractory materials consumed therein is large as described below: (1) since refining by soft blowing (the agitation force of the molten iron within the converter is lowered, and the material transfer of [C] in the molten iron is made in a rate-determining state) is intentionally conducted and the (% T.Fe) concentration in the slag is maintained at least at about 15% to make the slag liable to foam, the iron loss increases, (2) in order to maintain the flowability of the slag, the refining temperature is increased so that the blowing-off temperature during dephosphorization refining becomes at least 1,400° C., and consequently the wear and melt loss of refractory materials at converter-inclined portions increase, and (3) since the dephosphorization efficiency is lowered due to a high blowing-out temperature, the slag basicity, $CaO/SiO_2$, is maintained at least at 3.0, and the flux cost increases. Accordingly, the technique has not been applicable to practical operations.

In the process as mentioned above, recycling decarbonizing slag as a dephosphorizing agent by leaving the decarbonizing slag having a high CaO concentration in the furnace and charging a molten iron of the next charge thereinto is effective in reducing flux costs. However, the decarbonizing slag in the converter generally has a high oxygen activity. As a result, when a molten iron is charged into the converter while the converter decarbonizing slag in a molten state is left therein, C in the molten iron explosively reacts with oxygen in the converter decarbonizing slag. There may, therefore, arise a problem that the converter operation is hindered by bumping or slag foaming.

DISCLOSURE OF THE INVENTION

The present invention has been achieved under such circumstances. Although separate refining is directed in order to desiliconizing and dephosphorizing a molten iron in the conventional process, the present invention makes it possible to combine the pretreatment steps in a converter process. An object of the present invention is to provide a refining process effective in greatly improving a heat margin and greatly reducing steel refining costs.

The subject matter of the present invention is as described below.

(1) A converter refining process wherein a molten iron is charged into a converter having a bottom-blowing function, and adding flux, top blowing oxygen and agitation by bottom blowing oxygen are carried out, said process comprising a first step of charging a molten iron having been desulfurized outside the converter in advance, or charging a molten iron into a converter, adding a desulfurizing agent and subjecting the molten iron to desulfurization refining, a second step of subjecting the molten iron to dephosphorization refining by adjusting a charged flux amount and a blown gas amount so that the basicity in the slag subsequent to the treatment and the end point of the molten iron temperature are controlled, a third step of discharging at least 60% of the dephosphorization refining slag while gas is continuously bottom blown, and a fourth step of conducting decarbonization refining by blowing oxygen.

(2) A converter refining process comprising the steps of charging a molten iron into a converter having a bottom-blowing function, dephosphorizing a molten steel by controlling the amounts of charged flux and charged coolants so that the $CaO/SiO_2$ ratio in slag becomes at least 0.7 and up to 2.5 and the molten steel temperature becomes at least 1,200° C. and up to 1,450° C. after the treatment, while the flow rate of bottom-blown gas is being controlled, so that an agitation energy $\epsilon$ of the formula $$\epsilon=0.0285\times Q\times 10^3\times T\times \log(1+L_o/1.48)/W$$

wherein $\epsilon$ is the agitation energy (Watt/T-S), Q is the flow rate of the bottom-blown gas ($Nm^3$/min), T is a bath temperature (K), $L_o$ is a bath depth (m), and W is the weight of the molten iron (ton), becomes at least 0.5 kW/ton.

(3) The converter refining process according to (2), wherein the process further comprises the step of top blowing oxygen so that the sum of a T.Fe concentration and a MnO concentration becomes from 10 to 35% by weight in the slag after the treatment.

(4) The converter refining process according to (3), wherein oxygen is top blown while a $L/L_o$ ratio of the formula $$L/L_o=L_h \exp(-0.78h/L_h)/L_o$$

wherein $L_o$ is a bath depth (m) ,h is a height of a top-blowing lance for oxygen, L is represented by the formula $L_h \exp(-0.78\ h/L_h)$ and is a recess depth, $L_h$ is represented by the formula $63.0\times (k/Q_{02}/nd)^{2/3}$(wherein $Q_{02}$ is a flow rate of oxygen ($Nm^3$/h), n is a number of nozzles, d is a diameter of each of the nozzles (mm), and k is a constant determined by the ejecting angle of the nozzles, is being maintained at 0.1 to 0.3.

(5) A converter refining process comprising the steps of charging a molten iron into a converter having a bottom-blowing function, dephosphorizing a molten steel by controlling the amounts of charged flux and charged coolants so that the $CaO/SiO_2$ ratio in slag becomes at least 0.7 and up to 2.5 and the molten steel temperature becomes at least 1,200° C. and up to 1,450° C. after the treatment, while the flow rate of bottom-blown gas is being controlled, so that an agitation energy $\epsilon$ of the formula $$\epsilon=0.0285\times Q\times 10^3\times T\times \log(1+L_o/1.48)/W$$

wherein $\epsilon$ is the agitation energy (Watt/T-S), Q is the flow rate of the bottom-blown gas ($Nm^3$/min), T is a bath temperature (K), $L_o$ is a bath depth (m), and W is the weight of the molten iron (ton), becomes at least 0.5 kW/ton, interrupting the refining once, discharging at least 60% of the slag within the converter by tilting the converter, making the furnace stand vertically, and conducting decarbonization refining.

(6) The converter refining process according to (5), wherein the decarbonizing slag formed during decarbonization refining is left in the converter, a molten iron of the next charge is charged under the conditions that a T.Fe concentration and a MnO concentration in the slag and a slag temperature satisfy the following formula (1):

$$3.038\times 10^{8}\times[(\%T.Fe)+(\%MnO)]^2\times \exp(91400/(T_s\&T_m\&546);\ \leqq 0.1 \quad (1)$$

wherein (% T.Fe) is a weight proportion of iron oxide in the decarbonizing slag (sum of the iron concentrations of FeO and $Fe_2O_3$), (% MnO) is a weight proportion (%) of manganese oxide in the decarbonizing slag, $T_s$ is a decarbonizing slag temperature (°C.), and $T_M$ is a molten iron temperature (°C.) to be charged, and dephosphorization and decarbonization are conducted again.

BEST MODE FOR CARRYING OUT THE INVENTION

The present invention has been achieved by combine the desiliconization step and the dephosphorization step for a molten iron in a converter process. In order to maintain the capacity of a process for producing a steel having a low phosphorus content comparable to that of a steel produced by the current separate refining, rapid and complete discharge of dephosphorization refining slag becomes an essential condition. That is, discharging slag subsequently to the molten iron treating steps causes problems such as described below: (1) a molten metal flows out during slag discharge, and as a result the yield lowers; (2) the productivity lowers due to the increase in the discharge time; and (3) ensuring a high slag discharge ratio is extremely difficult, and a rephosphorization phenomenon takes place when there remains dephosphorizing slag containing $P_2O_5$ at a high concentration.

The present inventors have done research and development to improve the discharge efficiency of slag after desiliconizing and dephosphorizing a molten iron by utilizing a converter, combine pretreatment steps of the molten iron in a converter process, greatly improve a heat margin, and reduce flux costs.

First, the present inventors conducted experiments wherein a 300-ton converter having a bottom-blowing function in a practical installation scale was used, about 290 ton of a molten iron was charged thereinto, burnt lime for dephosphorization and iron ore were added, top-blown oxygen was supplied while bottom-blowing agitation was being conducted to effect desiliconization and dephosphorization, intermediate slag discharge was practiced by once interrupting blowing after dephosphorization and tilting the converter, and decarbonization blowing was continuously conducted. The molten iron had contained 0.40% of Si and 0.100% of P on the average before the treatment, and a desired temperature of the molten iron subsequent to dephosphorization had been determined to be 1,350° C. on the basis of a conventional knowledge for the purpose of achieving efficient dephosphorization reaction. Consequently, the present inventors have paid attention to the fact that the agitation force of bottom-blown gas and the slag composition subsequent to dephosphorization greatly influence a dephosphorization ratio and a slag discharge efficiency, and have found that there is an optimum composition of the slag satisfying both factors.

Figure 2:
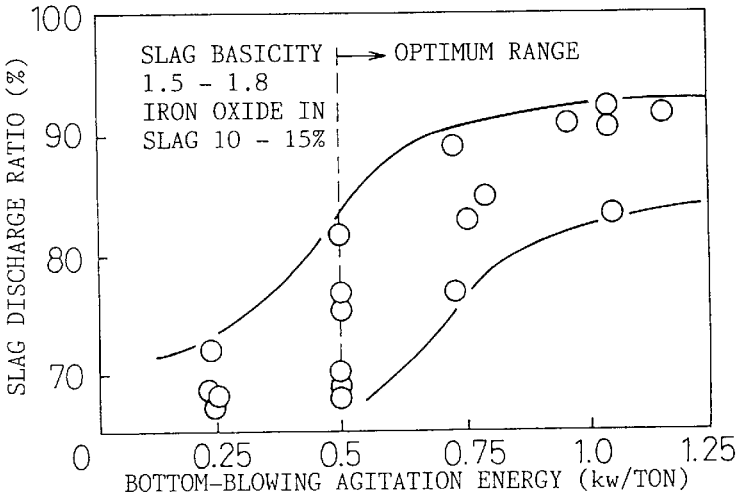
FIG. 2 is a graph showing the relationship between the bottom-blowing agitation energy and the slag discharge ratio.

That is, it can be seen from FIG. 2 that the slag discharge ratio is influenced by the agitation force of bottom-blown gas, and that the slag discharge ratio is sharply improved at an agitation energy of bottom-blown gas of at least 0.5 kW/ton even when the slag composition is the same. The slag discharge efficiency is improved because the bottom-blown gas enhances the slag-foaming level and slag discharge is conducted at a stage much earlier than that of intermediate slag discharge.

Furthermore, the present inventors have conducted various experiments on dephosphorization, and found that the apparent dephosphorization equilibrium in a molten iron is expressed by the following formula:

$$\log(\%P)/[\%P]=2.5\log[(\%T.Fe)+(\%MnO)]+0.0715\,[(\%CaO)+0.25(\%MgO)+7710.2/T-8.55+(105.1/T+0.0723)\,[\%C] \quad (2)$$

wherein (% P) is a phosphorus concentration in the slag, and [% P] is a phosphorus concentration in the molten iron.

The relationship between the bottom-blowing agitation energy and the apparent equilibrium accomplishment degree was investigated using the formula (2).

Concretely, dephosphorization experiments were conducted using an 8-ton test converter. About 6 tons of a molten iron which had an initial temperature of 1,180° to 1,300° C. and contained from 4 to 4.8% of C, from 0.1 to 0.15% of P and about 0.3% of Si was refined for 8 to 10 minutes. The molten iron was refined, with a predetermined amount of CaO charged as a flux, under the following conditions: a top-blown oxygen feed rate of 1.1 to 3.6 $Nm^3$min/ton, and a bottom-blown $N_2$ gas feed rate of 3 to 350 $Nm^3$/h (0.03 to 3.7 kW/ton). The $CaO/SiO_2$ ratio in the slag was from 0.6 to 2.5, and the molten iron temperature was from 1,250° to 1,400° C. after the treatment.

Figure 3:
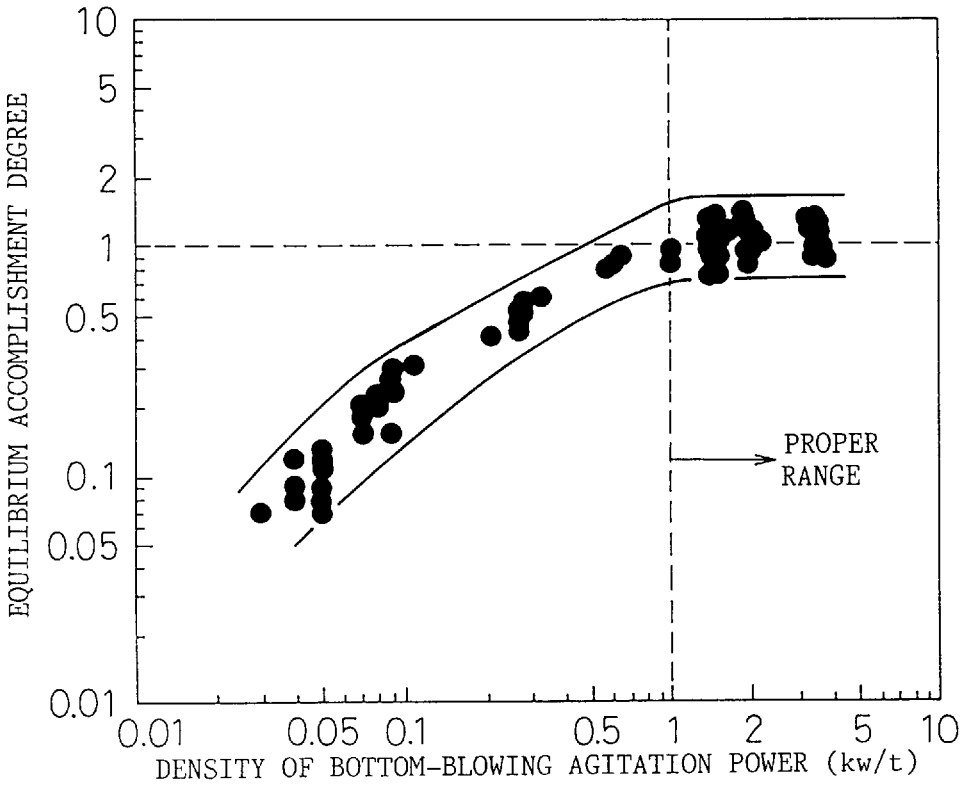
FIG. 3 is a graph showing the relationship between the bottom-blowing agitation power and an equilibrium accomplishment degree of dephosphorization.

FIG. 3 shows the relationship between the bottom-blowing agitation power and an equilibrium accomplishment degree (ratio of a record (P)/[P] ratio to a (P)/[P] ratio obtained from the formula (2)).

It has become evident from FIG. 3 that the dephosphorization reaction substantially proceeds to an equilibrium when the bottom-blowing agitation energy of at least 1 kW/ton is ensured. Although the bottom-blowing agitation power increases with the flow rate of bottom-blown gas, the gas is blown through the molten iron and spitting greatly increases when the gas flow rate becomes excessively large. The upper limit of the agitation energy is, therefore, determined in accordance with the bath depth of the molten iron and the diameter of a bottom-blowing tuyere, and that the blown gas has such an agitation energy that it is not blown through the molten iron.

An agitation energy is obtained from the following formula (3):

$$\epsilon=0.0285\times Q\times 10^3\times T\times\log(1+L_o/1.48)/W \quad (3)$$

wherein $\epsilon$ is the agitation energy (Watt/T-S), Q is the flow rate of bottom-blown gas ($Nm^3$/min), T is the bath temperature (K), $L_o$ is the bath depth (m), and W is the weight of the molten iron (ton) (reference: *Agitation Strength and Metallurgical Reaction in a Composite Converter* (1980), a document submitted to Japan Society for the Promotion of Science, Steel Making, No. 19 Committee, 3rd Section, Steel Making Reaction Conference).

Figure 4:
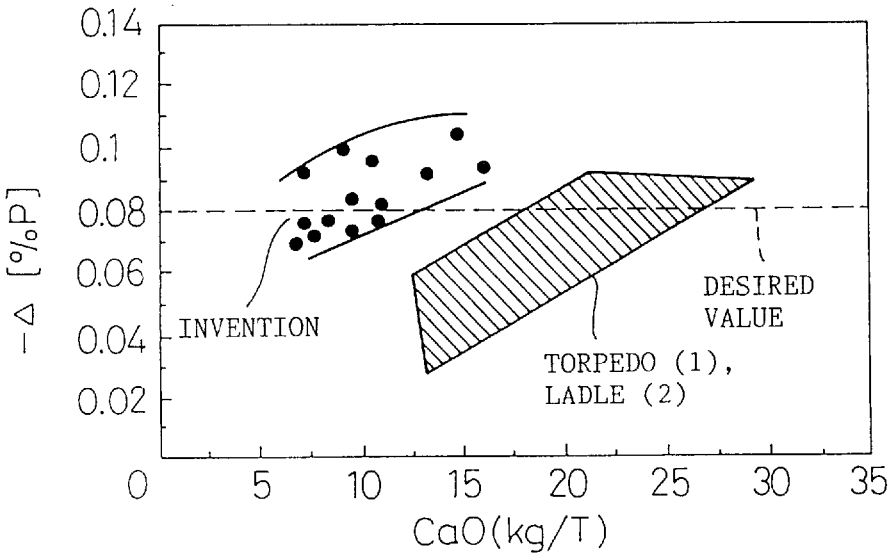
FIG. 4 is a graph showing the relationship between burnt lime consumption in dephosphorization refining and the dephosphorized amount.

FIG. 4 shows the relationship between burnt lime consumption and a dephosphorization amount in dephosphorization refining when a bottom-blowing agitation power of at least 1.0 kW/ton is practically applied. The relationship therebetween, in the conventional process wherein a torpedo car and a molten-iron ladle are used, is also shown for comparison. It is seen from FIG. 4 that the burnt lime consumption can be decreased by about 15 kg/ton compared with the conventional process.

Figure 5:
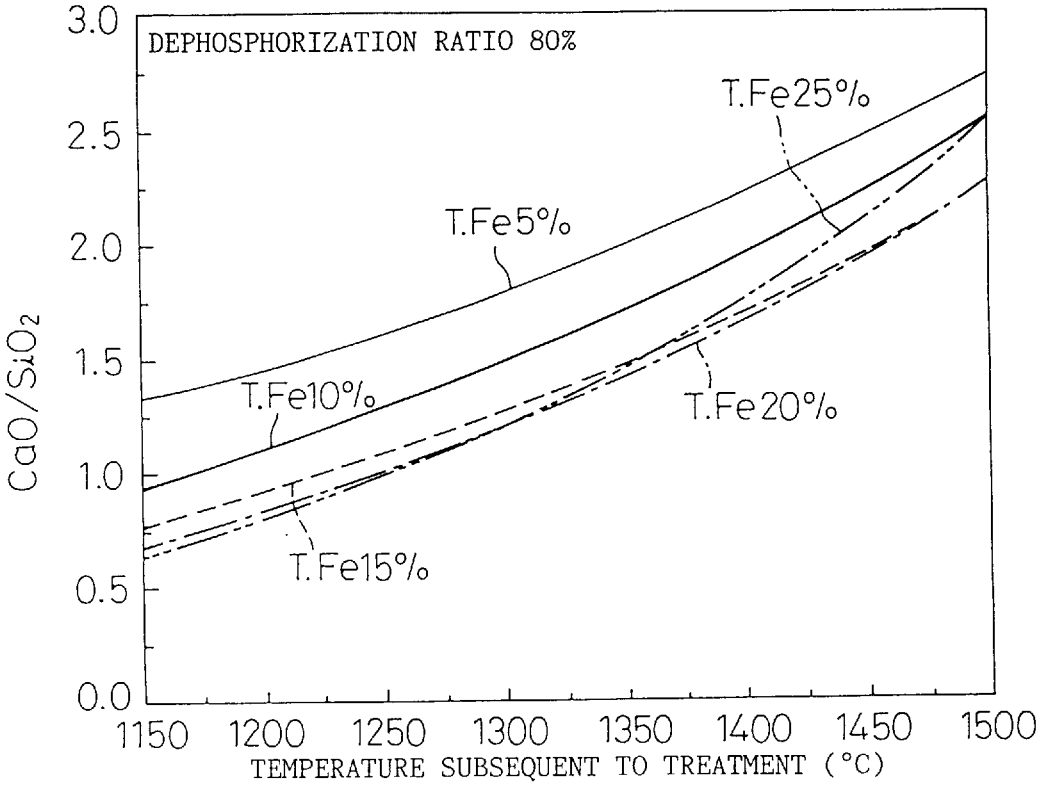
FIG. 5 is a graph showing the relationship between the molten iron temperature subsequent to treatment to obtain a dephosphorization ratio of 80% and the slag basicity.

Next, the present inventors variously investigated the relationship (for achieving a dephosphorization ratio of 80%) between a molten steel-treating temperature and a $CaO/SiO_2$ ratio in slag subsequent to treatment while the flow rate of bottom-blown gas was adjusted so that the agitation energy became at least 0.5 kW/ton. The results thus obtained are shown in FIG. 5. The present inventors carried out an intermediate slag discharge test by changing the temperature and the $CaO/SiO_2$ ratio in slag subsequent to the treatment, and investigated variously the relationship between the $CaO/SiO_2$ ratio and the slag discharge ratio. The results thus obtained are shown in FIG. 6.

Furthermore, the following converter operation was repeated using the same converter: a molten iron was dephosphorization refined; slag was discharged by tilting the converter; the converter was then made to stand vertically, and the molten iron was decarbonization refined; the steel thus obtained was tapped from the tap hole of the converter; and a molten iron was charged into the converter again while the decarbonizing slag was left therein. The relationship between a slag discharge ratio and an amount of CaO (sum of an amount of CaO used in the dephosphorization stage and an amount thereof used in the decarbonization stage) necessary for refining 1 ton of a molten iron was investigated. The results thus obtained are shown in FIG. 7.

Figure 7:
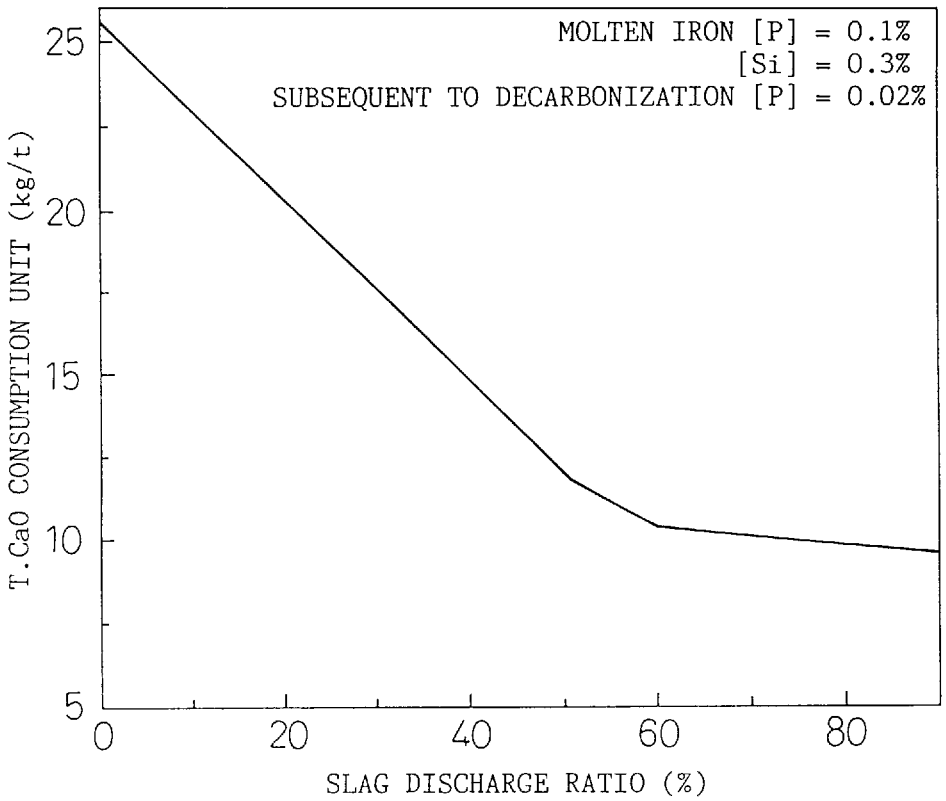
FIG. 7 is a graph showing the relationship between the discharge ratio of dephosphorizing slag and the consumption of total burnt lime, to obtain the same in blowing-off in the decarbonization stage.

It is evident from FIG. 7 that discharging slag as much as possible subsequent to dephosphorization is necessary for preventing rephosphorization, caused by low burnt lime consumption, and improving the yield of Mn ore in the decarbonization stage, and that although bringing a slag discharge ratio close to 100% as much as possible is effective in improving the yield of Mn ore, the decreasing ratio of the burnt lime consumption becomes small at a slag discharge ratio of at least 60% when viewed from the standpoint of decreasing dephosphorizing flux, and that the slag discharge ratio of at least 60% is, therefore, the minimum necessary one. It is seen from FIG. 7 that when the slag discharge ratio is at least 60%, the total amount of the burnt lime used in the dephosphorization stage and in the decarbonization stage may be made to amount to up to 10 kg/ton by recycling the decarbonizing slag. On the other hand, when the decarbonizing slag is not recycled, the sum of a consumption unit in the dephosphorization stage and in the decarbonization stage is about 15 kg/ton. Accordingly, recycling the decarbonizing slag may reduce a burnt lime consumption by about at least 5 kg/ton.

Figure 6:
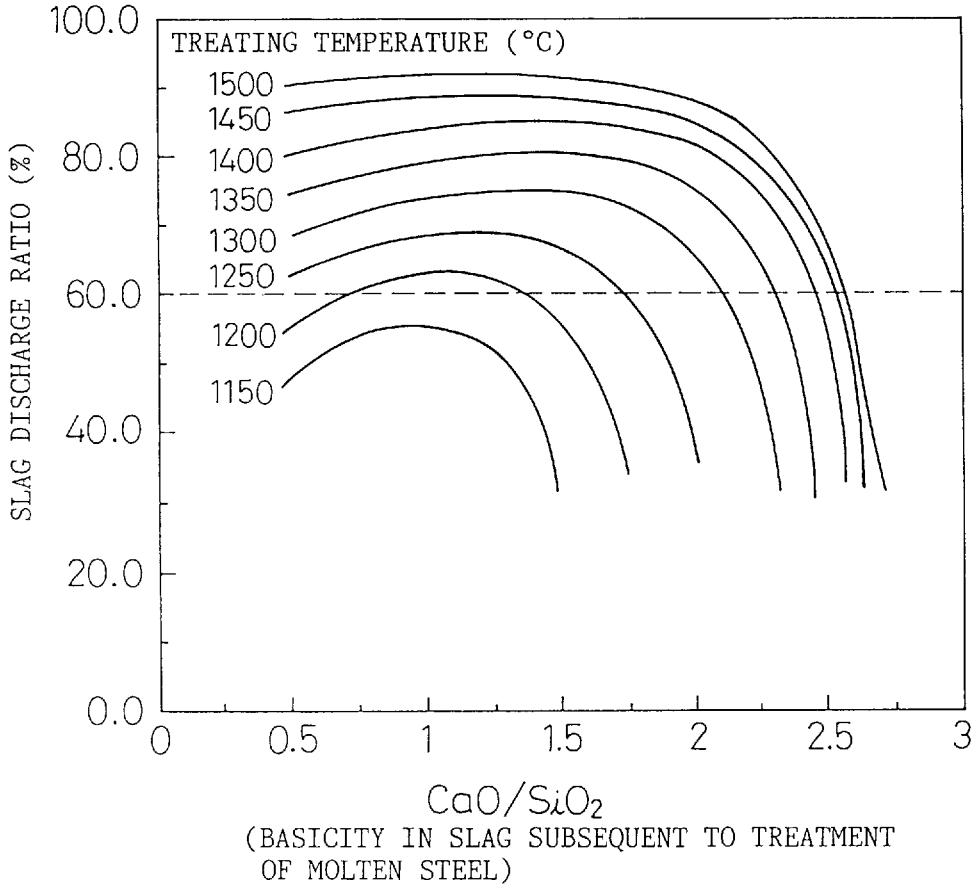
FIG. 6 is a graph showing the relationships between the molten iron temperature subsequent to dephosphorization refining, the slag basicity and the slag discharge ratio.

Furthermore, it is evident from FIG. 6 that when the temperature subsequent to the treating is less than 1,200° C., the slag discharge ratio does not reach 60% at any $CaO/SiO_2$ ratio subsequent to the treatment, and that when the temperature subsequent to the treatment exceeds 1,450° C., the slag discharge ratio also does not reach 60% at a $CaO/SiO_2$ ratio of at least the necessary one obtained from FIG. 5. Accordingly, in order to obtain a high dephosphorization efficiency and a high slag discharge efficiency, dephosphorization is required to be carried out so that the molten iron temperature subsequent to the treatment becomes at least 1,200° C. and up to 1,450° C. and the $CaO/SiO_2$ ratio in the slag subsequent thereto becomes at least 0.7 and up to 2.5.

The $CaO/SiO_2$ ratio in the slag subsequent to the treatment herein can be freely controlled by the amount of flux charged during dephosphorization refining, and the molten steel temperature subsequent to the treatment can also be freely controlled by coolants (scrap and iron ore) charged during dephosphorization refining.

That is, the desired slag discharge ratio of 60% as well as the desired dephosphorization amount can be sufficiently achieved at a $CaO/SiO_2$ ratio in the slag subsequent to the treatment of 0.7 to 2.5 in accordance with the molten iron temperature subsequent to the treatment which is from 1,200° to 1,450° C., under the condition of a bottom-blowing agitation power of at least 0.5 kW/ton.

Figure 8:
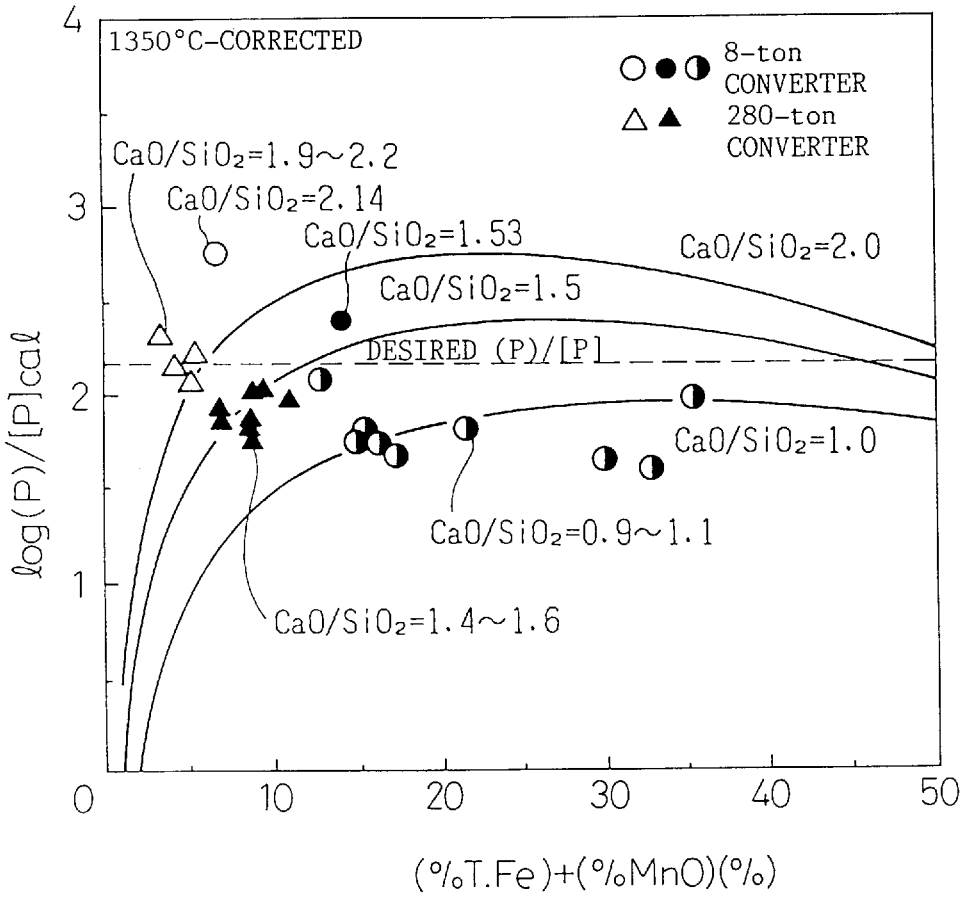
FIG. 8 is a graph showing the relationship between the sum of a T.Fe concentration and the MnO concentration in slag, and a (% P) [% P] ratio.

Furthermore, FIG. 8 shows the relationship between the sum of a T.Fe concentration and a MnO concentration and a (% P)/[% P] ratio at a molten iron temperature of 1,350° C. subsequent to the treatment, with the $CaO/SiO_2$ ratio in the slag subsequent to the treatment being 1.0, 1.5 or 2.0. It is seen from FIG. 8 that in any of the $CaO/SiO_2$ ratios, when the T.Fe becomes less than 10%, the (%P)/[%P] ratio falls sharply, and that the (%P)/[% P] ratio does not increase or rather falls when the T.Fe exceeds 35% ((% P) herein designates the concentration of P in the slag, and [% P] designates the concentration of P in the molten iron).

The phenomena take place for the reasons described below. When the sum of a T.Fe concentration and a MnO concentration in the slag becomes less than 10%, the (% P)/[%P] ratio falls sharply due to an insufficient oxygen potential. When the sum exceeds 35%, the (% P)/[%P] ratio also falls due to the dilution of a basic component concentration in the slag.

Accordingly, in order to obtain a high (% P)/[% P] ratio while the iron yield is being maintained, the sum of the T.Fe concentration and the MnO concentration subsequent to the treatment is desirably maintained at least at 10% and up to 35% as a better control parameter by operating the converter while adjusting a top-blown oxygen feed rate, a bottom-blown gas flow rate or the height of a top-blowing lance.

As a method for controlling the T.Fe subsequent to the treatment by adjusting the feed conditions of top-blown oxygen, there is an operating method wherein the $L/L_o$ ratio ((depth of the recess of the molten steel)/(height of a top-blowing lance for oxygen)) is utilized as an index.

The $L/L_o$ ratio herein is represented by the following formula:

$$L/L_o = L_h \exp(-0.78h/L_h)/L_o$$

wherein $L_o$ is a bath depth (m), h is the height of a top-blowing lance for oxygen, L is the depth of a molten steel recess and is represented by the formula $L_h \exp(-0.78 h/L_h)/L_0$, and $L_h$ is represented by the formula $63.0\times(k/Q_{02}/nd)^{2/3}$ (wherein $Q_{02}$ is the flow rate of oxygen ($Nm^3/h$), n is a number of nozzles, d is the diameter of each of the nozzles (mm), and k is a constant determined by the ejecting angle of the nozzles).

Basically, when the $L/L_o$ ratio is made smaller, the (% FeO) concentration in the slag increases, and dephosphorization becomes advantageous. Concretely, in order to lower the $L/L_o$ ratio, the lance height is required to be elevated. As the lance is elevated, the secondary combustion ratio within the furnace is increased, and the recovery amount of LDG is lowered or heat damage to the bricks in the inclined portions of the converter increases. Accordingly, the increase in the lance height is restricted. Moreover, when the $L/L_o$ ratio becomes smaller, slag foaming increases, and slopping which hinders the converter operation during blowing becomes more likely to take place. In view of what has been mentioned above, the minimum $L/L_o$ ratio is restricted to at least 0.1. Moreover, as the $L/L_o$ ratio increases, the (% T.Fe) in the slag is decreased, and the dephosphorization capacity is lowered. Accordingly, in order to ensure (the sum of the T.Fe concentration and the MnO concentration) of at least 10% in the slag during dephosphorization refining so that efficient dephosphorization refining can be practiced, the $L/L_o$ ratio is required to be restricted to up to 0.3. The following advantages can be obtained when the $L/L_o$ ratio is controlled to satisfy the conditions $0.1 \leqq L/L_o \leqq 0.3$: excessive slopping can be controlled during dephosphorization refining; and the in [% P] the molten iron can be stably controlled to be up to 0.030% while an extraordinary increase in the secondary combustion ratio of the exhaust gas is suppressed.

On the other hand, when the converter is operated while the bottom-blowing agitation energy, the $CaO/SiO_2$ ratio in slag subsequent to the treatment and the molten steel temperature subsequent thereto are adjusted in the ranges mentioned above, the dephosphorization time can be decreased with an increase in an oxygen feed rate.

Figure 9:
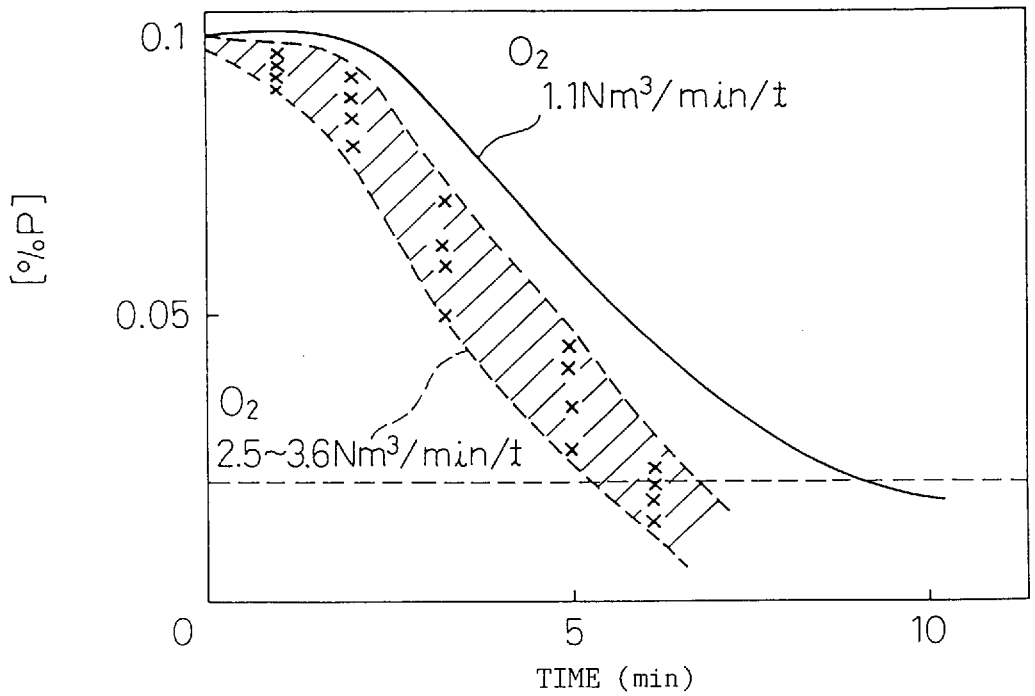
FIG. 9 is a graph showing the change with time of the [P] concentration in a molten iron.

FIG. 9 shows a change of the [P] concentration in the molten iron with time at different oxygen-blowing rates under the condition that the slag composition and the slag temperature subsequent to the treatment are each approximately constant. When oxygen is fed at a rate of at least 2.5 $Nm^3$/min/ton, the treating time can be decreased by about 4 minutes compared with the operation wherein oxygen is fed at a rate of 1.1 $Nm^3$/min/ton.

Figure 10:
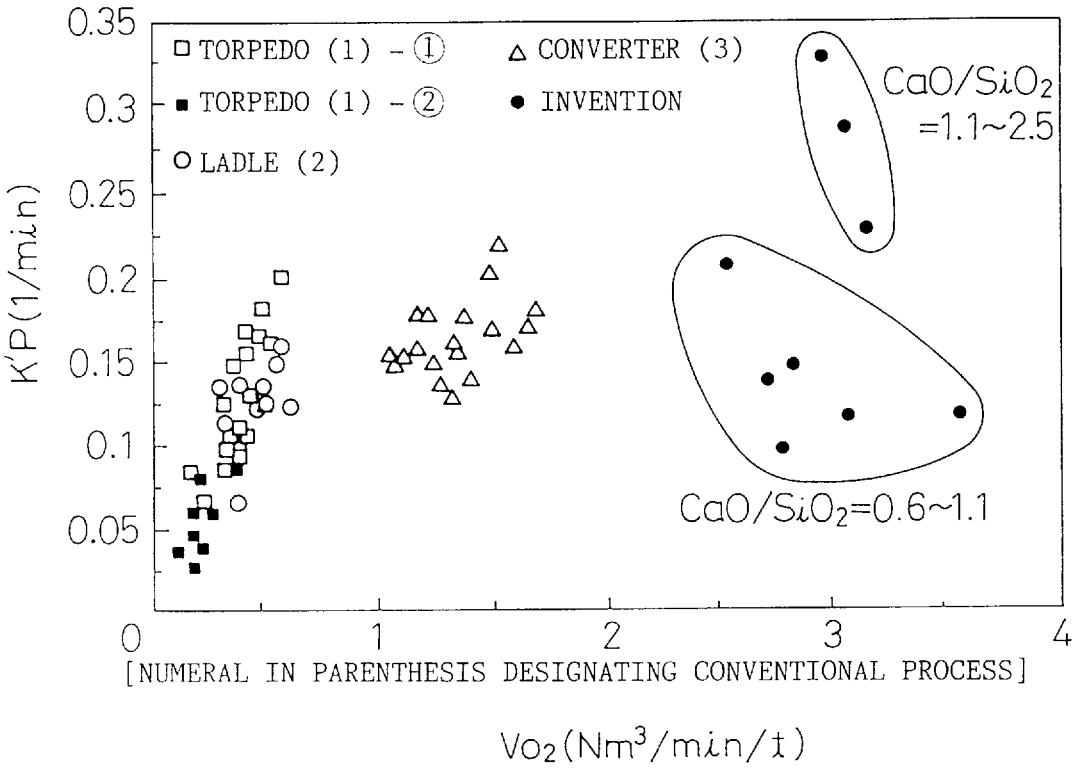
FIG. 10 is a graph showing the relationship between the feed rate of top-blown oxygen and the primary dephosphorization rate constant.

FIG. 10 shows the relationship between an oxygen feed rate and a primary dephosphorization rate constant (Kp'). FIG. 10 also shows the relationship in conventional processes (1), (2) and (3) in actual installations. Even when the $CaO/SiO_2$ ratio is lowered to 0.6 to 1.1 subsequent to the refining to decrease burnt lime consumption, a dephosphorization rate constant equivalent to that of the conventional process (1) using a torpedo car or that of the conventional process (2) using a ladle can be obtained by increasing the oxygen feed rate. When the $CaO/SiO_2$ ratio is at least 1.1 and up to 2.5, it is confirmed that a dephosphorization rate constant about twice as much as that of the conventional process (3) using the same converter can be obtained.

When proper dephosphorization satisfying conditions, such as the bottom-blowing agitation energy, the $CaO/SiO_2$ ratio in slag subsequent to the treatment and the molten steel temperature subsequent thereto, are present, rapid and complete discharge of the dephosphorization refining slag becomes possible, and the steps of desiliconization, dephosphorization and decarbonization can thus be combined in the converter.

That is, after proper dephosphorization, the converter is tilted, and the slag is discharged. As to steps subsequent to the slag discharge, the converter is immediately made to stand vertically, and flux such as burnt lime and light burned dolomite in the necessary and lowest amounts in accordance with a slag discharge ratio, a state of the melt loss of the furnace, a desired [P] concentration, etc. is charged in addition, followed by decarbonizing the molten iron by blowing oxygen until the molten iron has a desired end point [C]. Scrap, iron ore, Mn ore corresponding to a desired concentration, and the like may optionally be charged.

When the decarbonizing slag is recycled by leaving it in the converter and charging a molten iron of the next charge thereinto, the burnt lime consumption may greatly be cut as shown in FIG. 7. However, in some cases, C in the molten iron drastically reacts with oxygen sources in the converter decarbonizing slag, namely FeO, $Fe_2O_3$ and MnO according to the reaction formulas (4), (5) and (6):

$$FeO+C \rightarrow Fe+CO \quad (4)$$

$$Fe_2O_3+3C \rightarrow 2Fe+3CO \quad (5)$$

$$MnO+C \rightarrow Mn+CO \quad (6)$$

to form a large amount of a CO gas. The CO gas makes the slag and charged molten iron jump out from the converter and produces slag foaming so that the slag flows out of the converter. Thus, the CO gas generation in a large amount results not only in that the yield of iron is lowered but also that the operation may be obliged to be interrupted.

The amount of a CO gas produced by the reaction of the formulas (4) to (6) increases with a FeO, a $Fe_2O_3$ or MnO concentration in the slag. Moreover, the rates of these reactions increase with a temperature of the slag or molten iron. That is, the reaction becomes more drastic when the temperature is higher. However, even when the concentration of FeO, $Fe_2O_3$ or MnO in the slag is high, the reaction rates become slow at a low slag temperature or a low molten iron temperature. As a result, bumping or slag foaming may not take place sometimes.

As the result of investigating in detail the effects of concentrations of FeO, $Fe_2O_3$ and MnO, the slag temperature and the molten iron temperature on bumping and slag foaming, the present inventors have discovered that in order to prevent bumping and slag foaming, the formula (1) mentioned above must be satisfied. The formula (1) signifies that when the relationship of T.Fe (sum of the concentrations of iron in FeO and $Fe_2O_3$), a MnO concentration, a slag and a molten iron on the left side is up to 0.1, bumping and slag foaming do not take place. That is, the slag temperature or molten iron temperature is selected so that they match the concentrations of FeO, $Fe_2O_3$ and MnO in the slag, and as a result the value of the left side of the formula (1) becomes up to 0.1. When the molten iron is then charged, bumping and slag foaming may be prevented. Moreover, on the contrary, bumping and slag foaming may also be prevented by adjusting the concentrations of T.Fe and MnO in the slag on the basis of the slag temperature and the molten iron temperature so that the relationship of the formula (1) is satisfied, and by charging the molten iron.

In addition, there is a procedure wherein charging a molten iron is delayed until the decarbonizing slag temperature becomes the temperature determined by the sum of the concentrations of iron oxide and manganese oxide in the decarbonizing slag and a molten iron temperature of the next charge so that the formula (1) is satisfied. However, there may also be another procedure wherein a coolant such as $CaCO_3$ or a mixture of the coolant and a deoxidizing agent such as coke and smokeless coal is added to forcibly satisfy the formula (1).

For example, when $CaCO_3$ is used as the coolant, $CaCO_3$ is decomposed into CaO and $CO_2$. Since the decomposition reaction is endothermic, the decarbonizing slag temperature is lowered, and the conditions of the formula (1) can be satisfied in a short period of time. Moreover, since CaO produced by decomposition acts as a flux in dephosphorization reaction, flux for dephosphorization in the dephosphorization stage can be advantageously reduced.

The sum of the concentrations of iron oxide and manganese oxide in the decarbonizing slag is determined either by sampling a slag sample and rapidly analyzing it or by obtaining in advance the relationship between a carbon concentration in the molten steel and the sum of an iron oxide concentration and a manganese oxide concentration in the decarbonizing slag and calculating the sum from the analytical results of the carbon concentration in the molten steel of the previous charge after decarbonization. Moreover, the decarbonizing slag temperature is measured by a radiation thermometer, etc.

Figure 1:
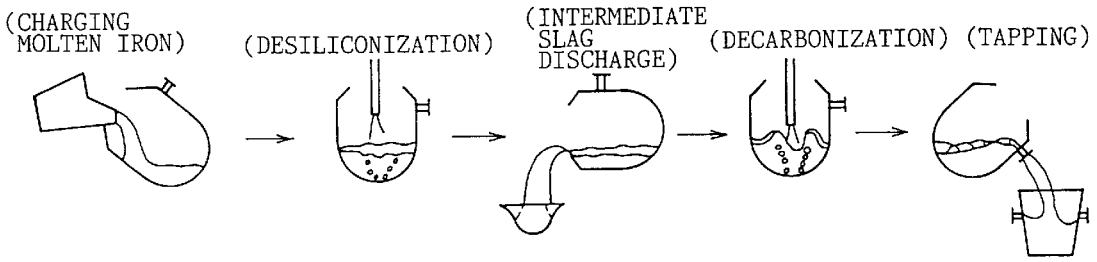
FIG. 1 is a view showing the process flow of the present invention.

FIG. 1 shows the outline of the entire process.

The present invention has been illustrated above on the basis of the cases where a molten iron having been predesulfurized outside a converter is used. When predesulfurization of high degree is not required, the molten iron can be desulfurized within a converter before dephosphorization as described above. That is, desulfurizing flux which is one or at least two substances selected from CaO, $Na_2CO_3$ and Mg is charged by top charging or bottom-blowing injection, and then desulfurization is conducted in a short period of time of 2 to 5 minutes. Dephosphorization as mentioned above is subsequently conducted. Since from 40 to 60% of S in the slag is then vaporized and desulfurized, desulfurization of from 30 to 50% of [S] in the molten iron at the initial stage in combination with dephosphorization becomes possible by adjusting the flux amount.

Figure 11:
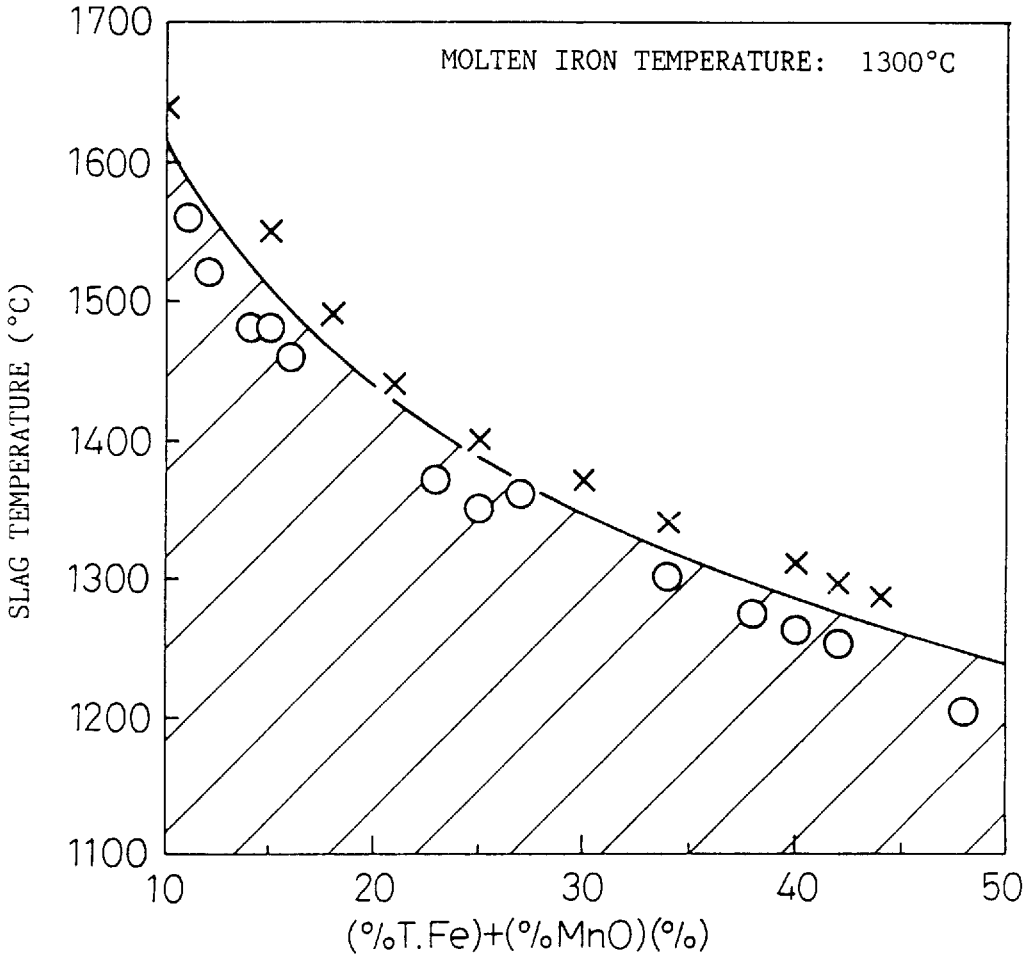
FIG. 11 is a graph showing the relationship between the sum of the iron oxide concentration and the MnO concentration in decarbonizing slag and the bumping-critical decarbonizing slag temperature.

In addition, when slag is discharged by tilting the converter, the converter is desirably turned in a short period of time such as within 1 minute (as short as possible) while the slag is being prevented from scattering with a slag-preventive plate in front of the converter as shown in FIG. 11.

The present invention will be explained in detail on the basis of examples.

EXAMPLES

Example 1

Into an 8-ton test converter having a bottom-blowing function was charged about 6 tons of a molten iron which had been predesulfurized. The molten iron was dephosphorized for about 8 minutes by controlling the amounts of charged flux and charged scrap so that the $CaO/SiO_2$ ratio in the slag became at least 0.7 and up to 2.5 and the molten steel temperature became at least 1,200° C. and up to 1,450° C. after the treatment, while the flow rate of bottom-blown gas was controlled so that the agitation energy became at least 0.5 kW/ton. The furnace was subsequently tilted, and intermediate slag discharge was conducted for about 3 minutes. The furnace was made to stand vertically, and decarbonization was immediately carried out for about 9 minutes, followed by tapping the resulting steel.

Table 1 shows concrete conditions, chemical compositions of molten steels, and temperature changes of the steels.

The molten iron subsequent to dephosphorization had [P] of 0.025%, and the resulting molten steel subsequent to decarbonization had [P] of 0.019%. The total amount of burnt lime added in both the predesulfurization stage and dephosphorization and decarbonization stage in the converter was about 20 kg/ton. The consumption could thus be significantly cut compared with the average total burnt lime consumption of 34 kg/ton in a conventional process (desulfurization and dephosphorization of the molten iron + decarbonization in the converter) for obtaining refining effects equivalent to those in the present invention.

The results could be obtained due to the application of dephosphorization operation conditions of the present invention which were consistent with a high slag discharge ratio and a high dephosphorization efficiency.

TABLE 1

Principal Conditions of Practice

| | | | | | |
|---|---|---|---|---|---|
| Amount of charged molten iron | 6180 kg | | | | |
| Dephosphorization Stage | | Decarbonization Stage | | | |
| Flow rate of top-blown $O_2$ | 1000 $Nm^3/h$ | Flow rate of top-blown $O_2$ | | 1500 $Nm^3/h$ | |
| Flow rate of bottom-blown $N_2$ | 350 $Nm^3/h$ | Flow rate of bottom-blown gas | $O_2$ | 200 $Nm^3/h$ | |
| Amount of charged scrap | 1200 kg | | Ar | 125 $Nm^3/h$ | |
| Amount of charged burnt lime | 70 kg | | LPG | 20 $Nm^3/h$ | |
| Treating time | 7.8 min | Amount of charged burnt lime | | 50 kg | |
| | | Treating time | | 8.9 min | |

Chemical Composition of Metal, Temperature Change

| | [% C] | [% Si] | [% Mn] | [% P] | [% S] | Temp. (°C.) |
|---|---|---|---|---|---|---|
| Before treatment | 4.52 | 0.31 | 0.30 | 0.104 | 0.010 | 1350 |
| After dephosphorization | 3.62 | 0.01 | 0.09 | 0.025 | 0.010 | 1352 |
| After decarbonization | 0.037 | <0.01 | 0.05 | 0.019 | 0.010 | 1648 |

Example 2

Into an 8-ton test converter having a bottom-blowing function was charged about 6 tons of a molten iron which had been predesulfurized. The molten iron was dephosphorized for about 8 minutes by controlling the amounts of charged flux and charged scrap so that the $CaO/SiO_2$ ratio in the slag became at least 0.7 and up to 2.5 and the molten steel temperature became at least 1,200° C. and up to 1,450° C. after the treatment, while the flow rate of bottom-blown gas was being controlled so that the agitation energy became at least 0.5 kW/ton. The converter was subsequently tilted, and intermediate slag discharge was conducted in about 3 minutes. The converter was made to stand vertically, and decarbonization was immediately carried out for about 9 minutes, followed by tapping the resulting steel. Four charges of the molten iron were subjected to the refining operation while amounts of scrap charged were changed.

Table 2 shows conditions such as the chemical composition, the temperature, etc. of each of the charges.

It can be seen from the results that scrap in a large amount of about 17% could be charged according to the process of the present invention having a high heat margin, whereas scrap only in an amount of about 7% could be charged in the conventional process where dephosphorization and decarbonization were conducted in a torpedo car and in a converter, respectively.

Furthermore, it can also be seen from the results that when [Si] in the molten iron is increased, the molten iron may be dephosphorized at a lower basicity due to an increase in the amount of slag formed in the dephosphorization stage, and that as a result the burnt lime consumption unit does not increase much. Even when [Si] in the molten iron is increased, the operation is stabilized without drastic slopping due to an operation with a low basicity and at low temperatures. The operation may be conducted with a scrap ratio of 25% using a molten iron having an [Si] content of 1%.

TABLE 2

| Molten Iron before Treatment | | | | | | | |
|---|---|---|---|---|---|---|---|
| Charge No. | Weight (kg) | [% C] | [% Si] | [% Mn] | [% P] | [% S] | Temp. (°C.) |
| 1 | 6050 | 4.52 | 0.31 | 0.30 | 0.104 | 0.020 | 1350 |
| 2 | 5990 | 4.52 | 0.52 | 0.29 | 0.099 | 0.020 | 1352 |
| 3 | 6020 | 4.45 | 0.65 | 0.29 | 0.101 | 0.020 | 1345 |
| 4 | 6010 | 4.53 | 0.95 | 0.31 | 0.102 | 0.020 | 1348 |

| Chemical Composition of Metal; Temperature Change, Burnt Lime Consumption Unit | | | | | | | |
|---|---|---|---|---|---|---|---|
| | After dephosphorization | | | After Decarbonization | | | Burnt lime consumption |
| Charge No. | Temp. (°C.) | [% C] | [% P] | Temp. (°C.) | [% C] | [% P] | (kg/ton) |
| 1 | 1345 | 3.52 | 0.018 | 1648 | 0.034 | 0.021 | 19.7 |
| 2 | 1353 | 3.43 | 0.019 | 1640 | 0.042 | 0.019 | 24.8 |

TABLE 2-continued

| | | | | | | | |
|---|---|---|---|---|---|---|---|
| 3 | 1352 | 3.55 | 0.020 | 1652 | 0.037 | 0.019 | 27.3 |
| 4 | 1352 | 3.51 | 0.020 | 1650 | 0.038 | 0.019 | 31.3 |

| Amount of Molten Scrap | | |
|---|---|---|
| Charge No. | Amount of molten scrap(kg) | Scrap ratio(%) |
| 1 | 1220 | 16.8 |
| 2 | 1360 | 18.5 |
| 3 | 1525 | 20.2 |
| 4 | 1970 | 24.7 |
| Prior art | — | about 7% ([Si] in molten iron 0.3%) |

Example 3

Into an 8-ton test converter having a bottom-blowing function was charged about 6 tons of a molten iron which had not been desulfurized, and the molten iron was desulfurized by adding a desulfurizing agent thereto. The molten iron was dephosphorized for about 8 minutes by controlling the amounts of charged flux and charged scrap so that the $CaO/SiO_2$ ratio in the slag became at least 0.7 and up to 2.5 and the molten steel temperature became at least 1,200° C. and up to 1,450° C. after the treatment, while the flow rate of bottom-blown gas was controlled so that the agitation energy became at least 0.5 kW/ton. The converter was subsequently tilted, and intermediate slag discharge was conducted for about 3 minutes. The converter was made to stand vertically, and decarbonization was immediately carried out for about 9 minutes, followed by tapping the resulting steel.

Table 3 shows concrete conditions, chemical compositions of molten steels, and temperature changes of the steels.

[S] of 0.030% in the molten iron at the initial stage became 0.010% after desulfurization, 0.015% after dephosphorization and 0.014% after decarbonization. It was, therefore, found that the molten iron could be sufficiently desulfurized to the level of an ordinary steel.

TABLE 3

| Auxiliary Raw Material and Treating Time | | | | |
|---|---|---|---|---|
| | Desulfurization | Dephosphorization | Intermediate slag discharge | Decarbonization |
| Consumption unit of auxiliary raw material | Desulfurizing agent 4.9 kg/ton* | burnt lime 10.1 kg/ton | — | burnt lime 7.3 kg/ton |
| Treating time | 3.2 min | 8.0 min | 3.1 min | 8.8 min |

| Chemical Composition of Metal, Temperature Change | | | | | | |
|---|---|---|---|---|---|---|
| | [% C] | [% Si] | [% Mn] | [% P] | [% S] | Temp. (°C.) |
| Before treatment | 4.46 | 0.31 | 0.31 | 0.101 | 0.030 | 1350 |
| After desulfurization | 4.41 | 0.30 | 0.30 | 0.090 | 0.010 | 1335 |
| After dephosphorization | 3.49 | 0.01 | 0.09 | 0.021 | 0.015 | 1351 |
| After decarbonization | 0.037 | <0.01 | 0.05 | 0.019 | 0.014 | 1648 |

Note: *desulfurizing agent: 50% CaO + 30% $Na_2CO_3$ + 20% Mg

Example 4

Table 4 shows each of the examples wherein a molten iron was charged into a 300-ton top- and bottom-blowing converter equipped with a bottom-blowing tuyere at the bottom in an amount of 290 to 300 ton, $CO_2$ and $O_2$ were blown thereinto from the bottom-blowing tuyere and the top-blowing lance, respectively.

Comparative Examples 1 to 3 are instances wherein the slag basicity subsequent to dephosphorization was at least 2.0, or a molten iron was refined with a decreased agitation force. Examples 4 to 7 were carried out according to the present invention. The basicity of a molten iron could be easily adjusted by charging burnt lime in an amount in accordance with an amount of $SiO_2$ to be formed from Si in the molten iron before the treatment, and an amount of $SiO_2$ remaining in the slag in the furnace, etc.

It is seen from the results of the examples that the intermediate slag discharge ratio subsequent to dephosphorization can be greatly improved by applying the present invention compared with conventional processes, that rephosphorization can be inhibited in the decarbonization step continuously carried out after slag discharge, and that carrying out desiliconization, dephosphorization and decarbonization refining in one furnace may be satisfactorily carried out.

Figure 12:
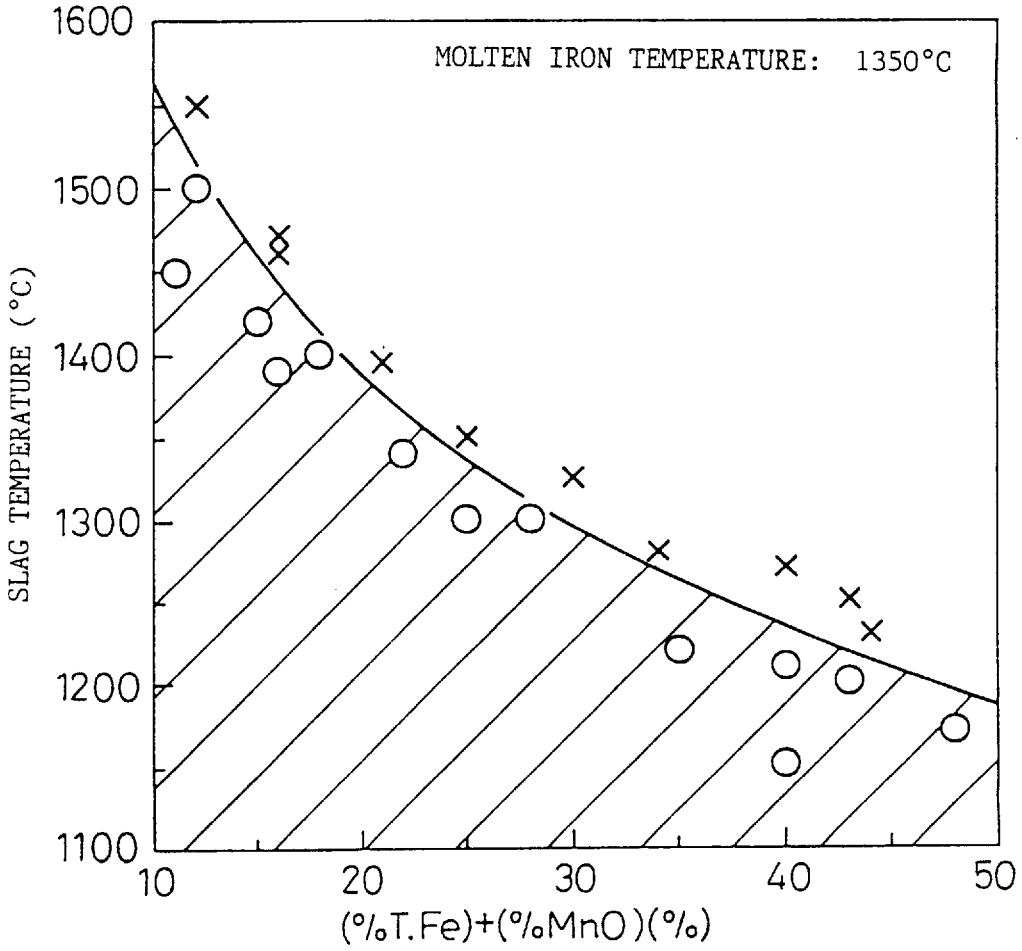
FIG. 12 is a graph showing the relationship between the sum of the iron oxide concentration and the MnO concentration in decarbonizing slag and the bumping-critical decarbonizing slag temperature.
Figure 13:
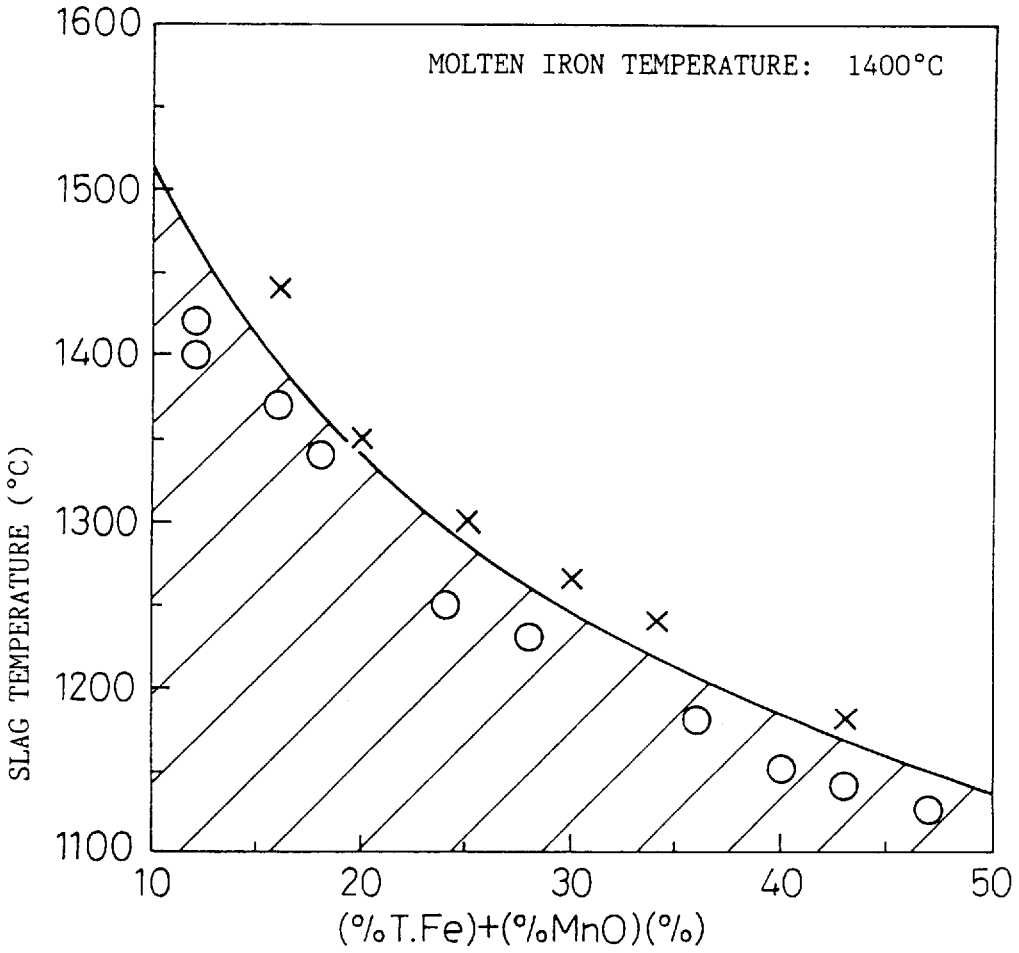
FIG. 13 is a graph showing the relationship between the sum of the iron oxide concentration and the MnO concentration in decarbonizing slag and the bumping-critical decarbonizing slag temperature.
Figure 14:
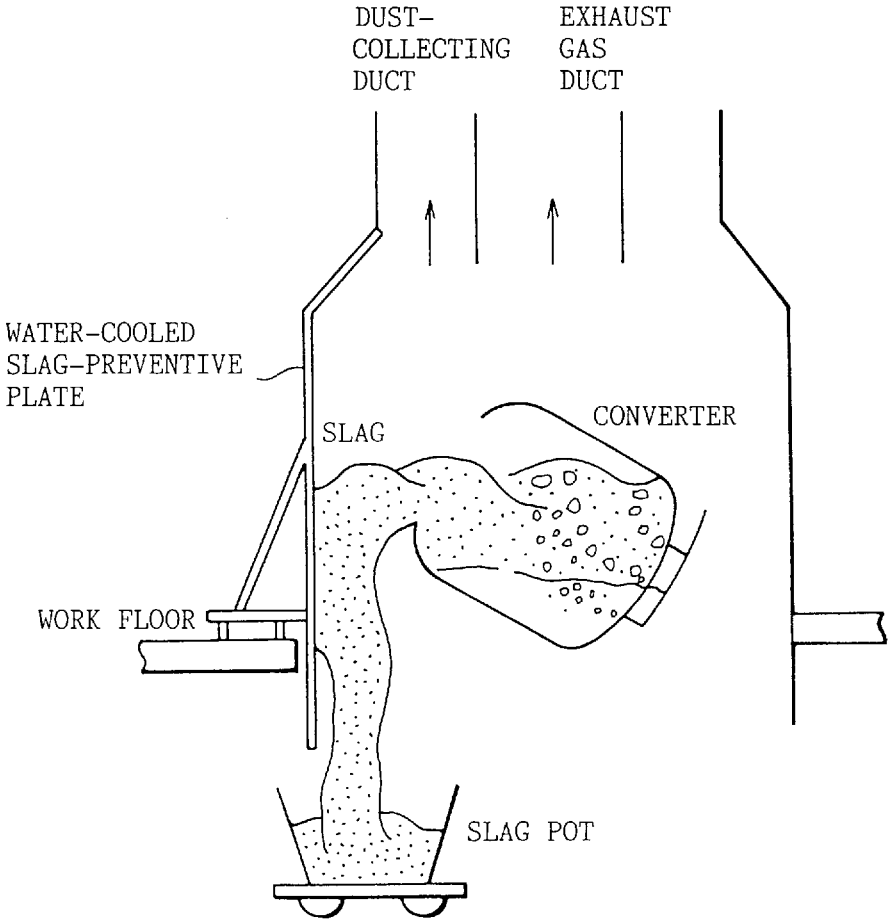
FIG. 14 is a view showing a state for rapidly discharging dephosphorizing slag.

In addition, the chemical composition of the molten iron was as follows: a [C] concentration of 4.5 to 4.8%, a [Si] concentration of 0.39 to 0.41%, and a [P] concentration of 0.099 to 0.103%. The amount of the decarbonizing slag which had been left in the converter was about 30 kg/ton. Moreover, even a molten iron which did not satisfy conditions of the formula (1) was also charged for comparison. Whether bumping or rapid foaming took place or not after the charging is shown in FIG. 11 to FIG. 13 at respective molten iron temperatures.

TABLE 4

| Test No. | Amount of molten iron (ton) | | Chemical compsn.+ of molten iron (%) C | Si | Mn | P | S | Temp. (°C.) | Dephos# time (min) | Dephos# ratio (%) |
|---|---|---|---|---|---|---|---|---|---|---|
| Comp. Ex. 1 | 289.8 | before T* | 4.37 | 0.39 | 0.21 | 0.094 | 0.030 | 1249 | 8 | 83.0 |
| | | after D# | 3.66 | 0.03 | 0.08 | 0.016 | 0.029 | 1342 | | |
| Comp. Ex. 2 | 294.7 | before T* | 4.20 | 0.36 | 0.12 | 0.105 | 0.015 | 1241 | 7 | 85.7 |
| | | after D# | 3.71 | 0.02 | 0.03 | 0.015 | 0.014 | 1348 | | |
| Comp. Ex. 3 | 294.0 | before T* | 4.43 | 0.39 | 0.26 | 0.099 | 0.012 | 1282 | 7 | 81.8 |
| | | after D# | 3.77 | 0.02 | 0.05 | 0.018 | 0.012 | 1350 | | |
| Ex. 4 | 304.3 | before T* | 4.43 | 0.42 | 0.17 | 0.097 | 0.012 | 1236 | 6 | 84.5 |
| | | after D# | 3.68 | 0.02 | 0.02 | 0.015 | 0.013 | 1341 | | |
| Ex. 5 | 307.6 | before T* | 4.33 | 0.37 | 0.23 | 0.096 | 0.014 | 1252 | 7 | 86.5 |
| | | after D# | 3.66 | 0.01 | 0.04 | 0.013 | 0.014 | 1360 | | |
| Ex. 6 | 291.5 | before T* | 4.39 | 0.28 | 0.16 | 0.094 | 0.017 | 1298 | 9 | 80.9 |
| | | after D# | 3.75 | 0.01 | 0.06 | 0.018 | 0.015 | 1390 | | |
| Ex. 7 | 298.9 | before T* | 4.42 | 0.34 | 0.26 | 0.113 | 0.024 | 1306 | 8 | 86.7 |
| | | after D# | 3.73 | 0.02 | 0.04 | 0.015 | 0.022 | 1371 | | |

| Test No. | Slag after Dephosphorization: Basicity | Iron oxide (%) | (MnO) (%) | Flow rate of bottom-blown gas $Nm^3$/min | Bath depth (m) | Energy of bottom-blowing agitation (kW/ton) |
|---|---|---|---|---|---|---|
| Comp. Ex. 1 | 2.34 | 12.7 | 1.50 | 12.0 | 2.1 | 0.73 |
| Comp. Ex. 2 | 3.65 | 12.1 | 0.95 | — | 2.2 | 0 |
| Comp. Ex. 3 | 1.72 | 16.8 | 1.52 | 6.0 | 2.2 | 0.37 |
| Ex. 4 | 1.68 | 13.4 | 1.30 | 11.0 | 2.3 | 0.71 |
| Ex. 5 | 1.82 | 14.1 | 1.70 | 10.7 | 2.3 | 0.69 |
| Ex. 6 | 1.75 | 10.5 | 1.31 | 19.5 | 2.2 | 1.26 |
| Ex. 7 | 1.56 | 7.2 | 3.50 | 22.0 | 2.2 | 1.41 |

| Test No. | Time for discharging slag (min) | Amount of molten metal flowing out during slag discharge (ton) | Amount of slag formed (ton) | Slag discharge ratio (%) |
|---|---|---|---|---|
| Comp. Ex. 1 | 5.5 | 0.7 | 12.0 | 41.0 |
| Comp. Ex. 2 | 3.5 | 1.1 | 14.3 | 26.4 |
| Comp. Ex. 3 | 4.0 | 0.6 | 15.6 | 58.2 |
| Ex. 4 | 5.0 | 0.3 | 14.0 | 86.0 |
| Ex. 5 | 3.2 | 0.3 | 15.6 | 93.2 |
| Ex. 6 | 4.3 | 0.1 | 13.7 | 89.4 |
| Ex. 7 | 4.5 | 0.2 | 11.3 | 80.4 |

Note: compsn.+ = composition
T* = Treatment
Dephos# = D# = Dephosphorization

Example 5

Using a 300-ton converter, decarbonizing slag formed in the preceding decarbonization step was left therein without discharging, and a molten iron of the next charge was charged thereinto. The converter was then operated by reutilizing the slag as flux for dephosphorization.

When the decarbonizing slag left in the furnace came to have a temperature defined by the molten iron temperature and the (% T.Fe+MnO) concentration of the decarbonizing slag so that conditions of the formula (1) were satisfied, the molten iron in an amount of 300 ton having a temperature of 1) 1,290° to 1,310° C., 2) 1,340° to 1,360° C. or 3) 1,390° to 1,410° C. was charged thereinto.

Each of the slant line portions in FIG. 11 to FIG. 13 is a region where the conditions of the formula (1) are satisfied. The mark o designates the case where bumping and slag foaming did not take place when the molten iron was charged. The mark X designates the case where bumping and slag foaming took place when the molten iron was charged. When a molten iron was charged without satisfying the conditions of the formula (1), bumping and slag foaming took place without fail. On the other hand, when a molten iron was charged while the conditions of the formula (1) were satisfied, neither bumping nor slag foaming took place, and the operation was not hindered.

Furthermore, there was practiced a comparative test wherein decarbonizing slag was discharged once from the converter, and the slag was crushed and used as dephosphorizing flux for a molten iron. However, in the present invention, the scrap ratio increased by 5% on the average and the heat margin was increased compared with the comparative test.

Dephosphorization was subsequently practiced, and the results were as follows: the reutilized decarbonizing slag acted as dephosphorizing flux; the CaO component in the decarbonizing slag was effectively used for dephosphorization; and the consumption unit of CaO to be charged in the dephosphorization stage could be reduced compared with the case where the decarbonizing slag was not reused.

INDUSTRIAL APPLICABILITY

It is evident from the examples as mentioned above that the present invention has the effects described below.

(1) The conventional dephosphorization step or conventional desulfurization and dephosphorization steps outside a converter can be done in the converter, and the fixed cost may be cut greatly.

(2) The variable cost may also be cut by cutting the flux consumption unit.

(3) Since the heat margin is improved by doing the steps in the converter, the practice of the present invention has optional operation advantages such as described below: 1) an improvement of the capacity of melting scrap, 2) an improvement of the yield of molten steel due to an increase in the reduction amount of iron ore, and 3) a decrease in the flux cost by substituting limestone for burnt lime.

(4) The total amount of slag discharged from the converter refining steps can be decreased to ⅔ of the amount in the conventional refining steps due to a decrease in the consumption unit of flux used.

We claim:

1. A converter refining process for obtaining a dephosphorized molten iron comprising the steps of charging a molten iron into a converter having a top-blowing function and a bottom-blowing function, dephosphorizing a molten iron by controlling the amount of charged flux and charged coolants so that the $CaO/SiO_2$ ratio in slag which was measured by mass becomes at least 0.7 and up to 2.5 and the molten iron temperature becomes at least 1,200° C. and up to 1,450° C. after the treatment, while the flow rate of bottom-blown gas is being controlled to obtain slag having an optimum foaming property, so that an agitation energy $\epsilon$ of the formula $$\epsilon = (2Q \cdot R \cdot T/W \cdot 1000/n/60) \cdot 2.31\ \mathrm{og}\{1 + \rho \cdot g \cdot L_o/P_a\} = 0.0285 \times 10^3 \cdot Q \cdot T \cdot \{\log(1 + L_o/1.48)\}/W$$

wherein $\epsilon$ is the agitation energy (watt/ton), Q is the flow rate of the bottom-blown gas ($Nm^3$/min) which was measured in a normal state, R is the universal gas constant (=8.314 J/mol/k), T is a bath temperature (K), n=22.4 (mol), $\rho$ is the molten iron density (=7000 kg/$m^3$), g is the acceleration due to gravity (=9.8 m/s), $L_o$ is a bath depth (m), $P_a$ is the atmospheric pressure (=101325 Pa), W is the weight of the molten iron (ton), becomes at least 0.5 kW/ton, interrupting refining once, discharging at least 60of the slag within the converter by tilting the converter, making the furnace stand vertically, and conducting decarbonization refining.

2. The converter refining process according to claim 1, wherein the process further comprises the step of top blowing oxygen so that the sum of a T.Fe concentration and an MnO concentration becomes from 10 to 35% by weight in the slag.

3. The converter refining process according to claim 1 or 2, wherein oxygen is top blown while a $L/L_o$ ratio of the formula $$L/L_o = Lh \cdot 10^{-3} \exp(-0.78h/L_h)/L_o$$

wherein $L_o$ is a bath depth (m), h is a height of a top-blowing lance for oxygen, L is represented by the formula $Lh \cdot 10^{-3} \exp(-0.78\ h/L_h)$ and is a recess depth, $L_h$ is represented by the formula $63.0 \times (k/Q_{02}/nd)^{2/3}$ (wherein $Q_{02}$ is a flow rate of oxygen ($Nm^3$/h), n is a number of nozzles, d is a diameter of each of the nozzles (mm), and k is a constant determined by the ejecting angle of the nozzles, is being maintained at 0.1 to 0.3.

4. The converter refining process according to claim 1 or 2, wherein the decarbonizing slag formed during decarbonization refining is left in the converter, a molten iron of the next charge is charged under the conditions that a T.Fe concentration and a MnO concentration in the slag and a slag temperature satisfy the following formula (1):

$$3.038 \times 10^8 \times [(\%\ T.Fe) + (\%\ MnO)]^2 \times \exp(91400/(T_s \& T_m \& 546)) \leqq 0.1 \quad (1)$$

wherein (% T.Fe) is a weight proportion of iron oxide in the decarbonizing slag (sum of the iron concentrations of FeO and $Fe_2O_3$), (% MnO) is a weight proportion (%) of manganese oxide in the decarbonizing slag, $T_s$ *is a decarbonizing slag temperature (°C.), and* $T_M$ is a molten iron temperature(°C.) to be charged, and dephosphorization and decarbonization are conducted again.

* * * * *